US008393933B2

(12) United States Patent
Qian et al.

(10) Patent No.: US 8,393,933 B2
(45) Date of Patent: Mar. 12, 2013

(54) POLISHING PAD AND SYSTEM WITH WINDOW SUPPORT

(75) Inventors: Jun Qian, Sunnyvale, CA (US); Dominic J. Benvegnu, La Honda, CA (US); Ningzhuo Cui, Santa Clara, CA (US); Boguslaw A. Swedek, Cupertino, CA (US); Thomas H. Osterheld, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 575 days.

(21) Appl. No.: 12/644,972

(22) Filed: Dec. 22, 2009

(65) Prior Publication Data

US 2010/0184357 A1 Jul. 22, 2010

Related U.S. Application Data

(60) Provisional application No. 61/145,435, filed on Jan. 16, 2009.

(51) Int. Cl.
*B24B 49/00* (2012.01)

(52) U.S. Cl. ..... 451/6; 451/8

(58) Field of Classification Search ..... 451/6, 8, 451/285
See application file for complete search history.

(56) References Cited

U.S. PATENT DOCUMENTS

| | | | | |
|---|---|---|---|---|
| 5,007,209 | A | 4/1991 | Saito et al. | |
| 6,068,539 | A * | 5/2000 | Bajaj et al. | 451/6 |
| 6,149,506 | A | 11/2000 | Duescher | |
| 6,586,337 | B2 | 7/2003 | Parikh | |
| 6,599,765 | B1 | 7/2003 | Boyd et al. | |
| 6,878,039 | B2 * | 4/2005 | Yang et al. | 451/6 |
| 6,953,515 | B2 * | 10/2005 | Boyd et al. | 156/345.16 |
| 6,991,514 | B1 * | 1/2006 | Meloni et al. | 451/5 |
| 7,040,957 | B2 * | 5/2006 | Schultz et al. | 451/6 |
| 7,042,581 | B2 * | 5/2006 | Schietinger et al. | 356/630 |
| 7,081,044 | B2 * | 7/2006 | Ohta et al. | 451/59 |
| 2004/0033759 | A1 * | 2/2004 | Schultz et al. | 451/6 |
| 2004/0171329 | A1 | 9/2004 | Koinkar et al. | |
| 2005/0064802 | A1 * | 3/2005 | Wiswesser et al. | 451/285 |
| 2005/0173259 | A1 * | 8/2005 | Mavliev et al. | 205/645 |
| 2007/0042675 | A1 | 2/2007 | Benvegnu et al. | |
| 2007/0281587 | A1 * | 12/2007 | Wiswesser et al. | 451/8 |
| 2008/0102734 | A1 * | 5/2008 | Benvegnu et al. | 451/6 |
| 2008/0207089 | A1 * | 8/2008 | Lehman et al. | 451/6 |

FOREIGN PATENT DOCUMENTS

JP 11-151663 6/1999

OTHER PUBLICATIONS

Park Young Keun, Authorized Officer, Korean Intellectual Property Office, International Search Report and Written Opinion of PCT/US2009/067587 dated Jul. 15, 2010, 9 pages.

* cited by examiner

*Primary Examiner* — Maurina Rachuba
(74) *Attorney, Agent, or Firm* — Fish & Richardson P.C.

(57) ABSTRACT

A polishing system includes a polishing pad having a solid light-transmissive window, an optical fiber having an end, and a spacer having a vertical aperture therethrough. A bottom surface of the spacer contacts the end of the optical fiber, a top surface of the spacer contacts the underside of the window, and the vertical aperture is aligned with the optical fiber.

21 Claims, 3 Drawing Sheets

POLISHING PAD AND SYSTEM WITH WINDOW SUPPORT

CROSS-REFERENCE TO RELATED APPLICATIONS

This application claims the benefit of prior U.S. Provisional Application Ser. No. 61/145,435, filed Jan. 16, 2009, which is incorporated here by reference.

TECHNICAL FIELD

This disclosure relates to a polishing pad having a window for use in chemical mechanical polishing (CMP).

BACKGROUND

In the process of fabricating modern semiconductor integrated circuits (IC), it is often necessary to planarize the outer surface of a substrate. For example, planarization may be needed to polish away a conductive filler layer until the top surface of an underlying layer is exposed, leaving the conductive material between the raised pattern of the insulative layer to form vias, plugs and lines that provide conductive paths between thin film circuits on the substrate. In addition, planarization may be needed to flatten and thin an oxide layer to provide a flat surface suitable for photolithography.

One method for achieving semiconductor substrate planarization or topography removal is chemical mechanical polishing (CMP). A conventional chemical mechanical polishing (CMP) process involves pressing a substrate against a rotating polishing pad in the presence of an abrasive slurry.

In general, there is a need to detect when the desired surface planarity or layer thickness has been reached or when an underlying layer has been exposed in order to determine whether to stop polishing. Several techniques have been developed for the in-situ detection of endpoints during the CMP process. For example, an optical monitoring system for in-situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad.

SUMMARY

In one aspect, a polishing system includes a polishing pad having a solid light-transmissive window, an optical fiber having an end, and a spacer having a vertical aperture therethrough. A bottom surface of the spacer contacts the end of the optical fiber, a top surface of the spacer contacts the underside of the window, and the vertical aperture is aligned with the optical fiber.

Implementations can include one or more of the following features. The aperture may be aligned with a central axis of the optical fiber. A platen may support the polishing pad. The end of the optical fiber may be coplanar with a top surface of the platen. An outer perimeter of the spacer may be supported by the platen. The spacer may be spaced apart from and not contact the platen. The spacer may be secured, e.g., adhesively secured, to the optical fiber. The spacer may be secured, e.g., adhesively secured, to the window. The end of the optical fiber may project above a top surface of the platen. The spacer may comprise an O-ring. An outer diameter of the spacer may be smaller than an outer diameter of the optical fiber. The polishing pad may include a polishing layer and a backing layer. The spacer may be spaced apart from and not contact the backing layer. The spacer and backing layer may be formed of the same material. The spacer and the backing layer may have the same thickness. The underside of the window may be coplanar with a bottom surface of the polishing layer. An optical monitoring system may include a light source and a detector, and the optical fiber may include a first branch connecting the end to the light source and a second branch connecting the end to the detector.

In another aspect, a polishing system includes a polishing pad having a polishing layer and an optical fiber. The polishing pad includes a backing layer, a solid light-transmissive window in the polishing layer, and an aperture in the backing layer aligned with the window. The optical fiber has an end, the width of the aperture in the backing layer is smaller than the diameter of the optical fiber, the vertical aperture is aligned with the optical fiber, and a bottom surface of the backing layer contacts the end of the optical fiber.

Potential advantages may include one or more of the following. The tendency of a recess to form in the polishing pad window can be reduced, reducing the likelihood of collection of slurry in the optical path of the optical monitoring system. Reliability and accuracy of the optical monitoring system can be improved, and wafer-to-wafer polishing uniformity can be improved. Other features, objects, and advantages will be apparent from the description and drawings, and from the claims.

DETAILED DESCRIPTION

One potential problem in optical monitoring through a window in a polishing pad is that, because of its low glass transition temperature, the window material can deform at high processing temperatures. Because the central area of the window is not supported, the deformation can result in a recess in the center of the window. Slurry can collect in the recess. Because the slurry tends to absorb and scatter light, it can significantly degrade the performance of the optical monitoring system, particularly an optical monitoring system that uses spectrography, leading to inaccurate endpoint detection or inability to detect polishing endpoint.

However, by supporting the center of the window, e.g., with a spacer positioned on the tip of the fiber optical cable for transmitting the incident and reflected light, "sagging" of the window can be reduced, thus reducing slurry accumulation and improving signal intensity and reliability of the optical monitoring system.

Figure 1:
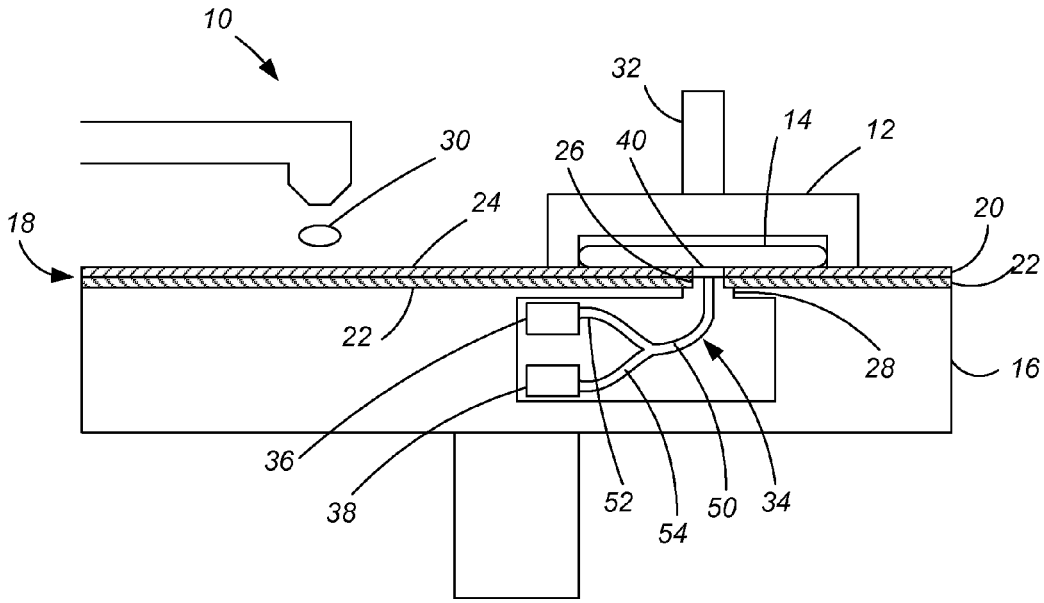
FIG. 1 is a schematic cross-sectional side view of a chemical mechanical polishing apparatus with an optical monitoring system for endpoint detection.

As shown in FIG. 1, a CMP apparatus 10 includes a polishing head 12 for holding a semiconductor substrate 14 against a polishing pad 18 on a platen 16.

The substrate can be, for example, a product substrate (e.g., which includes multiple memory or processor dies), a test substrate, a bare substrate, or a gating substrate. The substrate can be at various stages of integrated circuit fabrication, e.g., the substrate can be a bare wafer, or it can include one or more deposited and/or patterned layers. The term substrate can include circular disks and rectangular sheets.

The polishing head 12 applies pressure to the substrate 14 against the polishing pad 18 as the platen rotates about its central axis. In addition, the polishing head 12 is usually rotated about its central axis, and translated across the surface of the platen 16 via a drive shaft or translation arm 32. A polishing liquid 30, e.g., an abrasive slurry, can be distributed onto the polishing pad. The pressure and relative motion between the substrate and the polishing surface, in conduction with the polishing liquid, result in polishing of the substrate.

An optical monitoring system includes a light source 36, such as a white light source, and a detector 38, such as a spectrophotometer, in optical communication with a window 40 in the polishing pad 18. The light source and the detector can be located in and rotate with the platen 16, such that a monitoring light beam sweeps across the substrate once per platen rotation. For example, a bifurcated optical fiber 34 can include a trunk 50 with a portion that extends through a vertical channel 28 though the platen with a top end positioned in proximity to the window 40, a first branch 52 connected to the light source 36, and a second branch 54 connected to the detector 38. Light from the light source 36 passes through the first branch 52 and the trunk 50 to be directed through the window 40 onto the substrate 14, and light reflected from the substrate 14 can pass back through the trunk 50 and the second branch 52 of the optical fiber 34 to the detector 38. The trunk end 50 of the optical fiber 34 can be held by an optical head that includes a mechanism to adjust the vertical distance between the end of the bifurcated fiber cable 54 and the top surface of the platen 16. The light source can employ a wavelength anywhere from the far infrared to ultraviolet, such as red light, although a broadband spectrum, e.g., white light, can also be used, and the detector can be a spectrometer.

The polishing pad 18 can include a polishing layer 20 with a polishing surface 24 to contact the substrate and a backing layer 22 adhesively secured to the platen 16. The polishing layer 20 can be a material suitable for bulk planarization of the exposed layer on the substrate. Such a polishing layer can be formed of a polyurethane material, e.g., with fillers, such as hollow microspheres, e.g., the polishing layer can be the IC-1000 material available from Rohm & Hass. The backing layer 22 can be more compressible than the polishing layer 20. In some implementations, the polishing pad includes only the polishing layer, and/or the polishing layer is a relatively soft material suitable for a buffing process, such as a poromeric coating with large vertically oriented pores. In some implementations, grooves can be formed in the polishing surface 24.

The window 40 can be a solid light-transmitting material, e.g., a transparent material, such as a relatively pure polyurethane without fillers. The window 40 can be joined to the polishing layer 20 without adhesive, e.g., the abutting edges of the window 40 and polishing layer 20 are molded together. The top surface of the window 40 can be coplanar with the polishing surface 24, and the bottom surface of the window 40 can be coplanar with the bottom of the polishing layer 20. The polishing layer 18 can completely surround the window 40. An aperture 26 in the backing layer 22 is aligned with the window 40 in the polishing layer 20.

Figure 2:
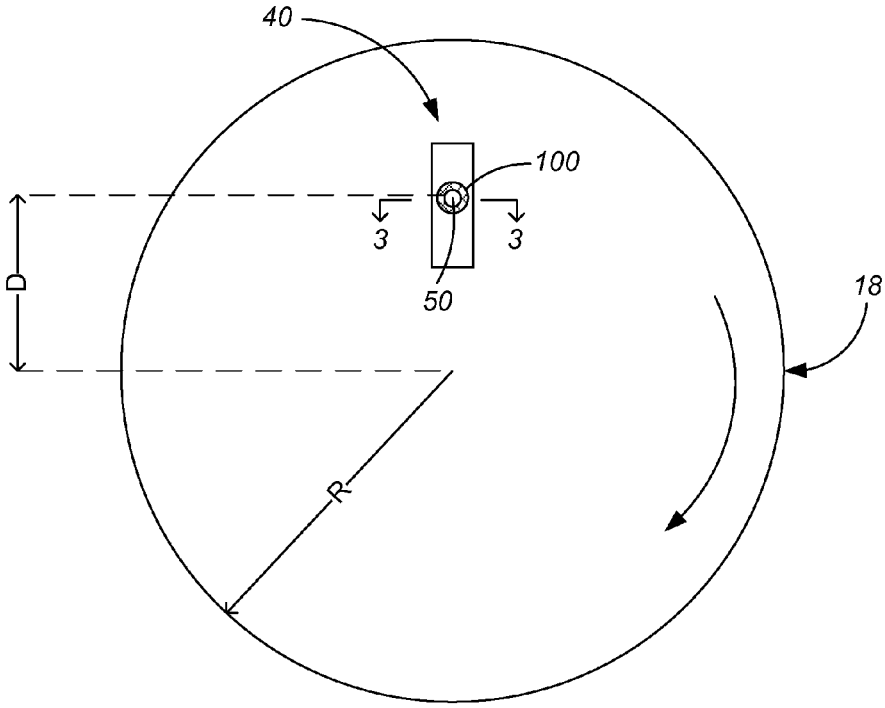
FIG. 2 is a simplified top view of the polishing pad of FIG. 1.

Referring to FIG. 2, in one implementation the polishing pad 18 has a radius R of 15.0 inches (381.00 mm), with a corresponding diameter of 30 inches. In other implementations, the polishing pad 18 can have a radius of 15.25 inches (387.35 mm), 15.5 inches (393.70 mm), 21.0 inches (533.4 mm) or 21.25 inches (539.75 mm) with corresponding diameter of 30.5 inches, 31 inches, 42 inches or 42.5 inches. The optical monitoring system can use an area about 0.5 inches (12.70 mm) wide and 0.75 inches (19.05 mm), long centered a distance D of about 7.5 inches (190.50 mm) (for pads of about 30 inch diameter) or about 12.15 inches (308.50 mm) (for pads of about 42 inch diameter) from the center of the polishing pad 18. Thus, the window should cover at least this area. For example, the window can have a length of about 2.25 (57.15 mm) inches and a width of about 0.75 inches (19.05 mm). Both the polishing pad and the window can have a thickness of about 0.02 to 0.20 inches, e.g., 0.05 to 0.08 inches (1.27 to 2.03 mm). The window 40 can have a rectangular shape with its longer dimension substantially parallel to the radius of the polishing pad that passes through the center of the window. However, the window 40 can have other shapes, such as circular or oval, and the center of the window need not be located at the center of the area used by the optical monitoring system.

Figure 3:
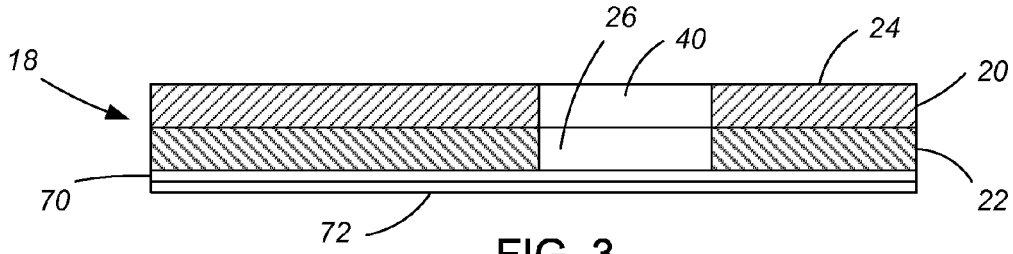
FIG. 3 is a schematic cross-sectional side view of a polishing pad.

Referring to FIG. 3, before installation on a platen, the polishing pad 18 can also include a pressure sensitive adhesive 70 and a liner 72 that spans the bottom surface 23 of the polishing pad. In use, the liner 72 is peeled from the polishing layer 20, and the polishing pad 18 is applied to the platen with the pressure sensitive adhesive 70. The pressure sensitive adhesive 70 and liner 72 can span the window 40 (and aperture 26), or either or both can be removed in and immediately around the region of the window 40.

To form the polishing pad 18, initially, a block of solid light transmitting polymer material can be formed. For example, a block of solid polyurethane, without fillers that inhibit transmission, can be cast and cut to desired dimensions. The light-transmissive block is placed in a mold and a liquid precursor of the polishing layer is then poured into the mold. The liquid precursor is then cured, e.g., baked, and removed from the mold to form a solid plastic body that is molded to the light-transmissive block. A thin polishing layer is then cut from body, e.g., by skiving with a blade. Because the skiving cuts through the block, the skived portion of the transmissive block forms a window that is molded to the polishing layer. The polishing layer with molded window can then be secured to the bottom layer, e.g., with a pressure sensitive adhesive.

Figure 4:
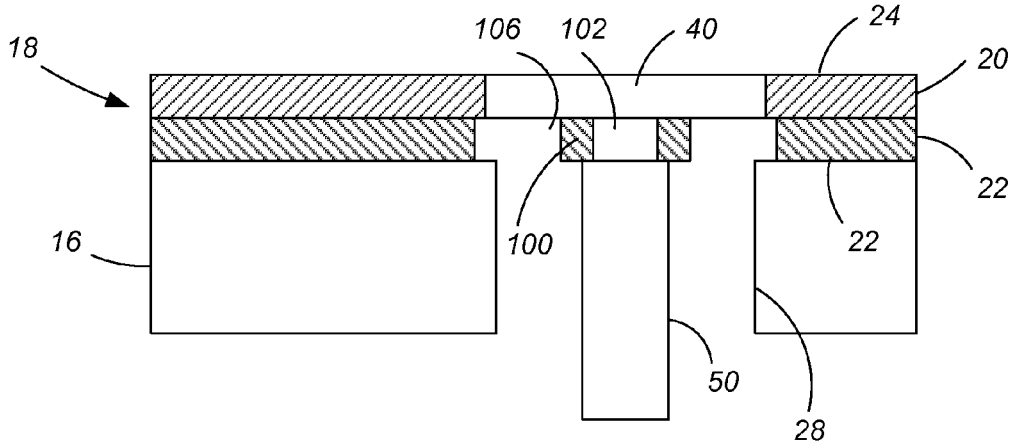
FIG. 4 is a simplified schematic cross-sectional view of an implementation of a polishing system including a polishing window support.

Turning now to FIG. 4, a support spacer 100 with an aperture 102 therethrough, e.g., an annular spacer, can be attached to the end of the trunk 50 of the optical fiber 34 before the polishing pad is secured to the platen 16. The spacer 100 can be secured to the end of the optical fiber 34 with double-sided adhesive tape. The outer diameter of the spacer 100 can larger than the diameter of the optical fiber 34. The hole 102 through the spacer 100 can be aligned with the central axis of the trunk 50 so that the spacer 100 does not block a significant portion of the light passing through the optical fiber 34. The spacer 100 can be also be spaced apart, i.e., does not contact, the platen 16, so that the only support for the spacer 100 is the optical fiber 34. Thus, the inner edge of the spacer (adjacent the aperture) rests on the optical fiber 34, whereas the outer edge of the spacer is unsupported.

When the polishing pad 18 is lowered onto the platen 16, the spacer 100 fits into the aperture 26 in the backing layer 22, with the top surface of the spacer 100 contacting the bottom surface of the window 40. Thus, the optical fiber 34 does not directly contact the window 40, and there is an air gap between the fiber 34 and window 40 defined by the aperture 102 in the spacer 100.

The sides of the spacer 100 can be separated from the sides of the backing layer 26 forming the aperture by a gap 106. The end of the optical fiber 34 can be flush with the top surface of the platen 16, and the spacer can have the same thickness 100 as the backing layer 26. The spacer 100 can be formed of the same material as the backing layer 26, e.g., it can be a piece of backing layer cut to form the annular spacer 100. An adhesive, e.g., a double-sided adhesive tape, can be placed on the top surface of the spacer 100 so that the spacer is also adhesively attached to the window 40.

Figure 5:
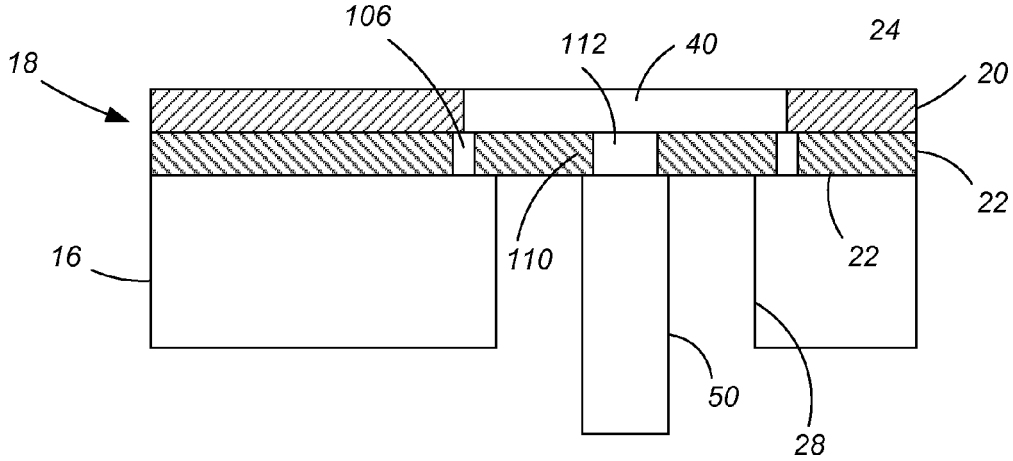
FIG. 5 is a simplified schematic cross-sectional view of another implementation of a polishing system including a polishing window support.

Turning now to FIG. 5, in another implementation, a support spacer 110 with an aperture 112 therethrough, e.g., an annular spacer, can be attached to the end of the trunk 50 of the optical fiber 34 before the polishing pad is secured to the platen 16. This support spacer 110 can be constructed similarly to the spacer described above with respect to FIG. 4, but the outer edge of the spacer 110 rests on the top surface of the platen 16. If present, the same double-sided adhesive tape that secures the spacer 110 to the optical fiber can secure the bottom of the spacer 110 to the top surface of the platen 16.

Figure 6:
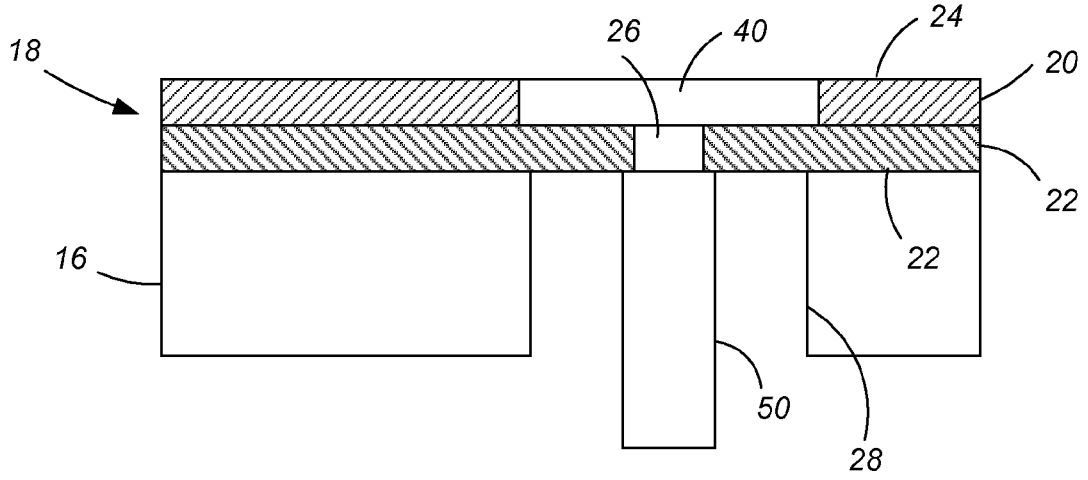
FIG. 6 is a simplified schematic cross-sectional view of another implementation of a polishing system including a polishing window support.

Turning now to FIG. 6, in another implementation, there is no separate spacer, but a portion of the backing layer 22 extends over and is supported by the trunk 50 of the optical fiber 34. In this implementation, the aperture 26 in the backing layer 22 is slightly smaller than the diameter of the optical fiber 34, and the aperture 26 is aligned with the central axis of the trunk 50 so that the backing layer 22 does not block a significant portion of the light passing through the optical fiber 34.

Figure 7:
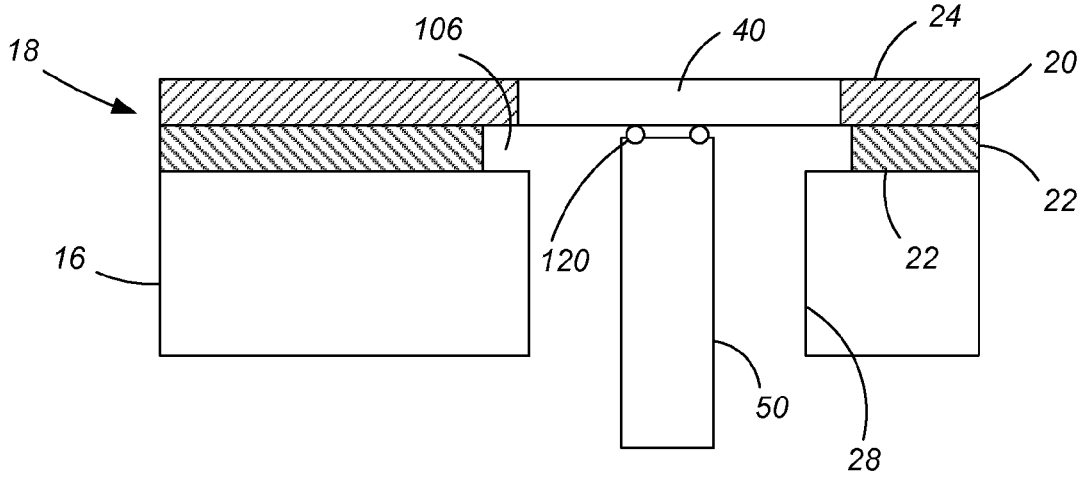
FIG. 7 is a simplified schematic cross-sectional view of another implementation of a polishing system including a polishing window support.

Turning now to FIG. 7, in another implementation, a support spacer 120 with an aperture 122 therethrough, e.g., an annular spacer, can be an O-ring attached to the end of the trunk 50 of the optical fiber 34 before the polishing pad is secured to the platen 16. The O-ring 120 can be adhesively attached to the top of the optical fiber 34, or rest in an annular recess in the top of the optical fiber 34. The aperture 122 through the O-ring 120 can be aligned with the central axis of the trunk 50 so that the spacer O-ring 120 does not block a significant portion of the light passing through the optical fiber 34. The outer diameter of the O-ring 120 can smaller than the diameter of the optical fiber 34. Because the O-ring 120 can be thinner than the backing layer 22, the optical fiber 34 can project above the top surface of the platen 16 (but be recessed below the top surface of the backing layer 22), such that the top of the O-ring 120 contacts the bottom surface of the window 40 when the polishing pad 18 is secured to the platen 16.

In each of the embodiments described above, since the optical fiber 34 is held vertically by the optical head, the spacer tends to support the center of the window 40, thus preventing sagging of the window in the center and consequently reducing slurry accumulation in the optical path from the optical fiber 34 to the substrate.

A number of embodiments have been described. Nevertheless, it will be understood that various modifications may be made without departing from the spirit and scope of the disclosure. Accordingly, other embodiments are within the scope of the following claims.

What is claimed is:

1. A polishing system, comprising:

a polishing pad having a solid light-transmissive window;

an optical fiber having an end; and a spacer having a vertical aperture therethrough, a bottom surface of the spacer contacting the end of the optical fiber, a top surface of the spacer contacting an underside of the window, the vertical aperture aligned with the optical fiber.

2. The polishing system of claim 1, wherein the aperture is aligned with a central axis of the optical fiber.

3. The polishing system of claim 1, further comprising a platen supporting the polishing pad.

4. The polishing system of claim 3, wherein the end of the optical fiber is coplanar with a top surface of the platen.

5. The polishing system of claim 3, wherein the spacer is not supported by the platen.

6. The polishing system of claim 3, wherein an outer perimeter of the spacer is supported by the platen.

7. The polishing system of claim 3, wherein the spacer is secured to the optical fiber.

8. The polishing system of claim 7, wherein the spacer is adhesively secured to the optical fiber.

9. The polishing system of claim 3, wherein the spacer is secured to the window.

10. The polishing system of claim 7, wherein the spacer is adhesively secured to the window.

11. The polishing system of claim 3, wherein the end of the optical fiber projects above a top surface of the platen.

12. The polishing system of claim 11, wherein the spacer comprises an O-ring.

13. The polishing system of claim 1, wherein an outer diameter of the spacer is smaller than an outer diameter of the optical fiber.

14. The polishing system of claim 13, wherein the spacer comprises an O-ring.

15. The polishing system of claim 1, wherein the polishing pad includes a polishing layer and a backing layer.

16. The polishing system of claim 15, wherein the spacer is spaced apart from and does not contact the backing layer.

17. The polishing system of claim 15, wherein the spacer and backing layer are formed of the same material.

18. The polishing system of claim 15, wherein the spacer and the backing layer have the same thickness.

19. The polishing system of claim 15, wherein the underside of the window is coplanar with a bottom surface of the polishing layer.

20. The polishing system of claim 1, further comprising an optical monitoring system including a light source and a detector, and wherein the optical fiber includes a first branch connecting the end to the light source and a second branch connecting the end to the detector.

21. A polishing system, comprising:

a polishing pad having a polishing layer, a backing layer, a solid light-transmissive window in the polishing layer, and an aperture in the backing layer aligned with the window; and an optical fiber having an end, the width of the aperture in the backing layer smaller than the diameter of the optical fiber, the vertical aperture aligned with the optical fiber and a bottom surface of the backing layer contacting the end of the optical fiber.

* * * * *